US005645654A

United States Patent [19]

Nishikawa et al.

[11] Patent Number: 5,645,654

[45] Date of Patent: Jul. 8, 1997

[54] NONMAGNETIC STAINLESS STEEL FOR HIGH BURRING AND METHOD OF MANUFACTURING THE SAME

[75] Inventors: Kiyoaki Nishikawa; Yoshihiro Ozeki; Toshiyuki Ono, all of Samukawa-machi, Japan

[73] Assignee: Nippon Mining & Metals Co., Ltd., Tokyo, Japan

[21] Appl. No.: 530,913

[22] Filed: Sep. 20, 1995

[30] Foreign Application Priority Data

Sep. 28, 1994 [JP] Japan ..... 6-257253

[51] Int. Cl.[6] ..... C22C 38/58

[52] U.S. Cl. ..... 148/327; 148/610

[58] Field of Search ..... 148/610, 327, 148/325

[56] References Cited

U.S. PATENT DOCUMENTS 3,989,474 11/1976 Goller et al. ..... 420/56
5,098,652 3/1992 Yasui et al. ..... 420/45

FOREIGN PATENT DOCUMENTS 62-272426 11/1987 Japan .
1-173536 12/1987 Japan .

OTHER PUBLICATIONS

Nakagawa et al., *Pressworking of Sheet Metals,* published by Jikkyo Shuppan K.K. (Oct. 10, 1977) pp. 179–185.

*Primary Examiner*—Deborah Yee
*Attorney, Agent, or Firm*—Seidel, Gonda, Lavorgna & Monaco, PC

[57] ABSTRACT

A nonmagnetic stainless steel for high burring has the absolute value of the plane anisotropy $\Delta r$ of the Lankford value r of 0.12 or under, the $\Delta r$ being $\Delta r=(r_0+r_{90}-2r_{45})/2$ wherein $r_0$, $r_{45}$, and $r_{90}$ are the r-values at angles of 0°, 45°, and 90°, respectively, to the direction of rolling to which the steel is subjected. The nonmagnetic stainless steel is useful for electron tube parts, especially for the electrodes of electron guns for color picture tubes and is made by the steps of adjusting the grain size of a nonmagnetic stainless steel before final rolling to the range from 4.0 to 7.0 in the austenite grain size conforming to JIS G0551, finishing the work to a desired thickness by final cold rolling to a cold reduction of 20 to 50%, and finally annealing the same to an austenite grain size according to JIS G0551 ranging from 7.0 to 12.0.

7 Claims, 1 Drawing Sheet

NONMAGNETIC STAINLESS STEEL FOR HIGH BURRING AND METHOD OF MANUFACTURING THE SAME

FIELD OF THE INVENTION

This invention relates to a nonmagnetic stainless steel for high burring and a method of manufacturing the same. More particularly, this invention relates to a nonmagnetic stainless steel, with excellent burring formability, for electron tube parts such as the electrodes of electron guns for color television picture tubes. This invention also relates to an electron tube part such as an electrode of electron guns for color television picture tubes having at least one burred portion where the burr height is more than one-third of the hole diameter which is made of such a nonmagnetic stainless steel.

BACKGROUND OF THE INVENTION

For electron tube parts, especially for the electrodes of electron guns for color picture tubes, nonmagnetic stainless steels have hitherto been used. The nonmagnetic stainless steels, with a certain extent of formability for both deep drawing and burring, have not posed major problems when used for the electrodes of electron guns for conventional-color picture tubes.

The term "burring" as used herein means a working technique whereby a round hole is made in sheet metal while forming a burr or flange protruding from the periphery of the hole. Burring is in wide use with holes for internal threading, bearing, reinforcement, and other purposes. More recently, the advent of higher refinement color picture tubes has made it necessary to increase the lens aperture diameter of the electrodes while performing burring with greater precision and forming higher or taller burrs (the burring for this purpose being called "high burring") so as to improve the focusing characteristics of the electron guns. High burring is required to ensure greater stabilization of the lens focusing characteristics.

Generally, the better the deep drawability and the higher the Lankford value of a material the lower the height of the burrs that can be formed on that material. To increase the height of the burrs, it is to practice to give a better finish to the edges of the holes or reduce the percentage of the inclusions in a material that can cause cracking. Other approaches include the use of a material that has been pickled after a heat treatment called 2D in final annealing or surface polishing of a finally annealed material for improved lubricity with respect to a die.

These approaches are effective to some degree in decreasing the frequency of occurrence of cracks due to burring. However, such decrease of crack occurrence frequency is not satisfactory, especially with the electrodes of electron guns where the burr height is more than one-third of the hole diameter. Another disadvantage is that the need of conditioning the hole ends or surface requires an additional number of process steps.

OBJECT OF THE INVENTION

An object of this invention is to develop a nonmagnetic stainless steel capable of being formed for high burring, forming burrs with a height in excess of one-third of the hole diameter.

Another object of this invention is to obtain an electron tube part, such as an electrode of an electron gun for color television picture tubes, having at least one burred portion where the burr height is more than one-third of the hole diameter which is made of a nonmagnetic stainless steel.

SUMMARY OF THE INVENTION

Our research for a further improvement in burring has led to the discovery of a correlation between plastic anisotropy and the frequency of occurrence of burring cracks. The plastic anisotropy can be expressed as the plane anisotropy $\Delta r$ of the Lankford value r. It has now been found that lowering the plane anisotropy $\Delta r$ of the Lankford value r to a value below a certain level renders it possible to decrease the frequency of occurrence of burring cracks to an extent that no longer affects the productivity. This invention is predicated upon this discovery.

By the "r-value" ("Lankford value") is meant the ratio, r=sheet width strain/sheet thickness strain, of the strains measured with changes in the width and thickness of a tensile test specimen sheet pulled to a predetermined elongation. The r-value is also known as a plastic anisotropy ratio because r is a parameter representing the thickness anisotropy too.

The r value varies when tests are made using different specimens taken in the rolling and other directions. Stated differently, the r value has plane anisotropy in itself. Usually, when an r value is to be evaluated for reference, test specimens cut out from a sheet to angles of 0°, 45°, and 90° to the direction of rolling of the sheet are pulled to obtain, respectively, $r_0$, $r_{45}$, and $r_{90}$ values (the r values at 0°, 45°, and 90° to the direction of rolling), and then the mean $r=(r_0+2r_{45}+r_{90})/4$ is calculated. The quantity that represents the plane anisotropy $\Delta r$ of a Lankford value r is found as $\Delta r=\{(r_0+r_{90})/2\}-r_{45}$ or $\Delta r=(r_0+r_{90}-2r_{45})/2$.

Based upon the above discovery, this invention provides a nonmagnetic stainless steel for high burring, particularly for electron tube parts, typically for the electrodes of electron guns for color television picture tubes, wherein the absolute value of the plane anisotropy $\Delta r$ of the Lankford value r for the steel is 0.12 or under, the $\Delta r$ being $\Delta r=(r_0+r_{90}-2r_{45})/2$ wherein $r_0$, $r_{45}$, and $r_{90}$ are the r-values at angles of 0°, 45°, and 90°, respectively, to the direction of rolling to which the steel is subjected.

This invention also is an electron tube part, typically an electrode of an electron gun for color television picture tubes, having at least one burred portion where the burr height is more than one-third of the hole diameter which is made of a nonmagnetic stainless steel wherein the absolute value of the plane anisotropy $\Delta r$ of the Lankford value r for the steel is 0.12 or under, the $\Delta r$ being $\Delta r=(r_0+r_{90}2r_{45})/2$ wherein $r_0$, $r_{45}$, and $r_{90}$ are other-values at angles of 0°, 45°, and 90°, respectively, to the direction of rolling to which the steel is subjected.

It has now been found that such a stainless steel can be obtained by properly controlling the grain size during the course of manufacture. This invention also provides a method of manufacturing a nonmagnetic stainless steel for high burring for which the absolute value of the plane anisotropy $\Delta r$ of the Lankford value r is 0.12 or under, the $\Delta r$ being $\Delta r=(r_0+r_{90}-2r_{45})/2$ wherein $r_0$, $r_{45}$, and $r_{90}$ are the r-values at angles of 0°, 45°, and 90°, respectively, to the direction of rolling to which the steel is subjected, comprising the steps of adjusting the grain size of a nonmagnetic stainless steel before final rolling to the range from 4.0 to 7.0 in the austenite grain size conforming to JIS G0551, finishing the work to a desired thickness by final cold rolling to a cold reduction of 20 to 50%, and finally annealing the same to an austenite grain size according to JIS G0551 ranging from 7.0 to 12.0.

DETAILED DESCRIPTION OF THE INVENTION

The basic technological concept of this invention is that a nonmagnetic stainless steel having a decreased plastic anisotropy is used as a material for high burring, typically for electron tubes, more particularly for the electrodes of electron guns for color television picture tubes. A decrease in the plane anisotropy of the Lankford value that represents plastic anisotropy delays the necking that occurs along the edge of sheet where the maximum stretch strain is generated at the time of burring. The delay of necking in turn retards cracking. This invention limits the absolute value of the plane anisotropy $\Delta r$ of the Lankford value to 0.12 or under for the following reason. In the case of high burring where a hole is burred to a height in excess of one-third of the hole diameter, a work with an absolute value above 0.12 can seriously affect the productivity with frequent burring cracking. Thus, the higher the ratio of the height of a burr to the diameter of the hole, the smaller the absolute $\Delta r$ value the better.

The nonmagnetic stainless steel to which this invention is applicable is, e.g., one consisting of 1 to 3% manganese, 9 to 15% nickel, 15 to 20% chromium, 0.01 to 0.05% carbon, and the balance iron and unavoidable impurities.

Such a nonmagnetic stainless steel for high burring can be manufactured by adjusting the grain size before final rolling to the range from 4.0 to 7.0 in the austenite grain size conforming to JIS G0551, finishing to a desired thickness by final cold rolling to a cold reduction of 20 to 50%, and then finally annealing to an austenite grain size according to JIS G0551 ranging from 7.0 to 12.0.

The grain size before final rolling has to be adjusted to the range of 4.0 to 7.0 in the austenite grain size defined in JIS G0551 for the reasons now to be explained. A large grain size before cold rolling inhibits the growth of the (112) [111] crystal texture that causes plastic anisotropy. There is no such effect when the austenite grain size of JIS G0551 is more than 7.0. If the grain size is less than 4.0, recrystallization tends to form a duplex grain structure no matter what step is taken in the working. The cold reduction by the final cold rolling is confined within the range of 20 to 50%, because a reduction of over 50% makes it impossible to inhibit the development and growth in the (112) [111] orientation while a reduction of less than 20% is prone to form a duplex grain structure after recrystallization. The reduction by the final cold rolling is preferably in the range of 35 to 50%. The grain size after the final annealing should be 7.0 to 12.0 in terms of the austenite grain size defined in JIS G0551, since a grain size smaller than 7.0 often causes an surface roughening after pressing and a size larger than 12.0 tends to leave more or less unrecrystallized metal behind.

Figure 1:
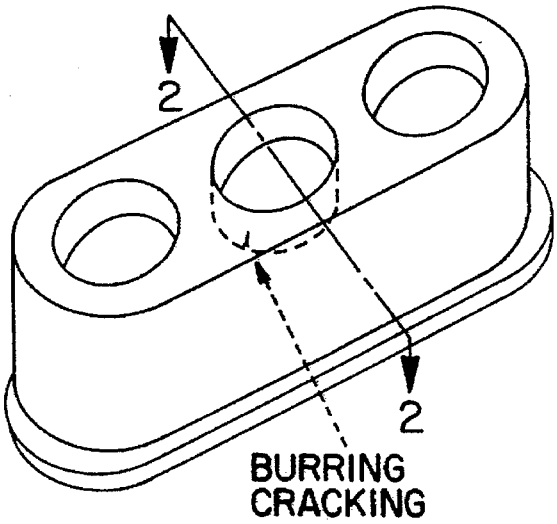
FIG. 1 is a prospective view of exemplary burred parts showing burring cracking.
Figure 2:
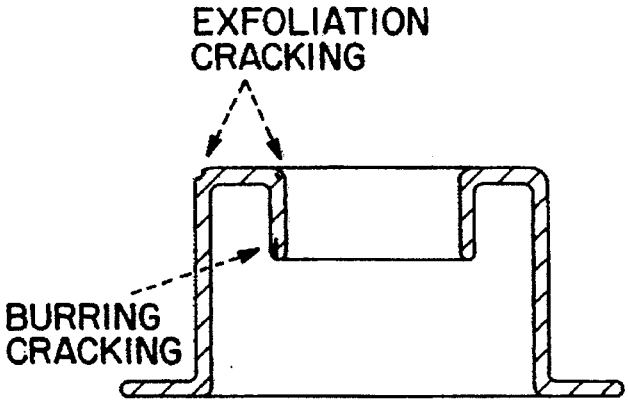
FIG. 2 is a sectional view taken along line 2—2 of FIG. 1 showing the same burring cracking, and also showing exfoliation cracking.

This invention will now be described in further detail in connection with its working examples and comparative examples. A 1.7 mm-thick sheet of stainless steel consisting of 1.6% Mn, 14% Ni, 16% Cr, 0.03% C, and the balance Fe and unavoidable impurities, all by weight, was repeatedly annealed and cold rolled to form a 0.245 mm-thick cold rolled sheet. It was then finally annealed to a grain size of 11.0 to 12.0 in terms of the austenite grain size defined in JIS G0551. The sheet so obtained was blanked and the blanks were perforated with holes 6 mm in diameter and burred to a height of 2 mm. The resulting burred parts, as shown in FIGS. 1, and 2 were inspected from the frequencies of occurrence, or percentages of exfoliation cracking and burring cracking. The parts shown simulate real burred components of an electron gun. The test was repeated under varied conditions and Table 1 lists the grain sizes before the final rolling, cold reductions of final cold rolling, absolute values of the plane anisotropy $\Delta r$ of the Lankford values, and percentages of exfoliation cracking and burring cracking. The burring operation was performed four times each forming 15,000 burred holes, from which 200 samples were chosen at random for the detection of defects, and each percent value in the table represents the average of the four defective percentages of those samples.

TABLE 1

| Specimen No. | Grain size before final cold rolling (austenite grain size), GS No. | Cold rolling reduction of final cold rolling, % | $\lvert\Delta r\rvert$ | Percent exfoliation cracking, % | Percent burring cracking, % |
|---|---|---|---|---|---|
| This invention | | | | | |
| 1 | 5.5 | 40 | 0.10 | 0 | 0.25 |
| 2 | 5.0 | 36 | 0.08 | 0 | 0.17 |
| 3 | 5.5 | 48 | 0.09 | 0 | 0.21 |
| 4 | 4.5 | 45 | 0.11 | 0 | 0.26 |
| Comparative | | | | | |
| 5 | 10.0 | 40 | 0.29 | 12.2 | 5.3 |
| 6 | 8.5 | 42 | 0.17 | 10.0 | 1.9 |
| 7 | 7.5 | 42 | 0.14 | 7.2 | 1.2 |

As is clear from Table 1, Specimens 1 to 4 whose absolute values of $\Delta r$ are below 0.12 in conformity with this invention have 0% of exfoliation cracking, and less than 0.3% of burring cracking. In contrast to these, comparative Specimens 5 to 7 are far inferior in respect of exfoliation and burring cracking, indicating their inability of being burred with good precision.

The nonmagnetic stainless steel according to this invention is capable of preventing burring cracking that can adversely affect the forming accuracy and productivity of the electrodes of electron guns for which high burring is to be performed. Moreover, the nonmagnetic stainless steel of the invention is free from exfoliation cracking too. These advantages make the steel most useful for the production of the electrodes for electron guns.

What is claimed is:

1. A nonmagnetic stainless steel for high burring consisting of, by weight, 1 to 3% manganese, 9 to 15% nickel, 15 to 20% chromium, 0.01 to 0.05% carbon, the balance being iron and unavoidable impurities, wherein the absolute value of the plane anisotropy $\Delta r$ of the Lankford value r for the steel is 0.12 or under, the $\Delta r$ being $\Delta r=(r_0+r_{90}-2r_{45})/2$ wherein $r_0$, $r_{45}$, and $r_{90}$ are the r-values at angles of 0°, 45°, and 90°, respectively, to the direction of rolling to which the steel is subjected.

2. A nonmagnetic stainless steel for electron tube parts, said stainless steel consisting of, by weight, 1 to 3% manganese, 9 to 15% nickel, 15 to 20% chromium, 0.01 to 0.05% carbon, the balance being iron and unavoidable impurities, wherein the absolute value of the plane anlsotropy $\Delta r$ of the Lankford value r for the steel is 0.12 or under, the $\Delta r$ being $\Delta r=(r_0+r_{90}-2r_{45})/2$ wherein $r_0$, $r_{45}$, and $r_{90}$ are the r-values at angles of 0°, 45°, and 90°, respectively, to the direction of rolling to which the steel is subjected.

3. A nonmagnetic stainless steel for the electrodes of electron guns for color television picture tubes, said stainless steel consisting of, by weight, 1 to 3% manganese, 9 to 15% nickel, 15 to 20% chromium, 0.01 to 0.05% carbon, the balance being iron and unavoidable impurities, wherein the absolute value of the plane anlsotropy $\Delta r$ of the Lankford value r for the steel is 0.12 or under, the $\Delta r$ being $\Delta r=(r_0+r_{90}2r_{45})/2$ wherein $r_0$, $r_{45}$, and $r_{90}$ are the r-values at angles of 0°, 45°, and 90°, respectively, to the direction of rolling to which the steel is subjected.

4. An electron tube part having at least one burred portion where the burr height is more than one-third of the hole diameter of the burred portion, which electron tube part is made of a nonmagnetic stainless steel consisting of, by weight, 1 to 3% manganese, 9 to 15% nickel, 15 to 20% chromium, 0.01 to 0.05% carbon, the balance being iron and unavoidable impurities, wherein the absolute value of the plane anlsotropy $\Delta r$ of the Lankford value r for the steel is 0.12 or under, the $\Delta r$ being $\Delta r=(r_0+r_{90}2r_{45})/2$ wherein $r_0$, $r_{45}$, and $r_{90}$ are the r-values at angles of 0°, 45°, and 90°, respectively, to the direction of rolling to which the steel is subjected.

5. An electrode of an electron gun for color television picture tubes having at least one burred portion where the burr height is more than one-third of the hole diameter of the burred portion, which electrode is made of a nonmagnetic stainless steel consisting of, by weight, 1 to 3% manganese, 9 to 15% nickel, 15 to 20% chromium, 0.01 to 0.05% carbon, the balance being iron and unavoidable impurities, wherein the absolute value of the plane anisotropy $\Delta r$ of the Lankford value r for the steel is 0.12 or under, the $\Delta r$ being $\Delta r=(r_0+r_{90}-2r_{45})/2$ wherein $r_0$, $r_{45}$, and $r_{90}$ are the r-values at angles of 0°, 45°, and 90°, respectively, to the direction of rolling to which the steel is subjected.

6. A nonmagnetic stainless steel for high burring consisting of, by weight, 1 to 3% manganese, 9 to 15% nickel, 15 to 20% chromium, 0.01 to 0.05% carbon, the balance being iron and unavoidable impurities, said steel having an absolute value of the plane anisotropy $\Delta r$ of the Lankford value r of 0.12 or under, the $\Delta r$ being $\Delta r=(r_0+r_{90}-2r_{45})/2$ wherein $r_0$, $r_{45}$, and $r_{90}$ are the r-values at angles of 0°, 45°, and 90°, respectively, to the direction of rolling to which the steel is subjected, said nonmagnetic stainless steel being produced by the steps of adjusting the grain size of a nonmagnetic stainless steel before final rolling to the range from 4.0 to 7.0 in austenite grain size number according to JIS G0551, finishing the work to a desired thickness by final cold rolling to a cold reduction of 20 to 50%, and finally annealing the work to an austenite grain size number according to JIS G0551 ranging from 7.0 to 12.0.

7. A method of manufacturing a nonmagnetic stainless steel for high burring for which the absolute value of the plane anisotropy $\Delta r$ of the Lankford value r is 0.12 or under, the $\Delta r$ being $\Delta r=(r_0+r_{90}-2r_{45})/2$ wherein $r_0$, $r_{45}$, and $r_{90}$ are the r-values at angles of 0°, 45°, and 90°, respectively, to the direction of rolling to which the steel is subjected, comprising the steps of providing a nonmagnetic stainless steel consisting of 1 to 3% manganese, 9 to 15% nickel, 15 to 20% chromium, 0.01 to 0.05% carbon, all by weight, the balance being iron and unavoidable impurities, adjusting the grain size of the nonmagnetic stainless steel before final rolling to the range from 4.0 to 7.0 in austenite grain size number according to JIS G0551, finishing the work to a desired thickness by final cold rolling to a cold reduction of 20 to 50%, and finally annealing the work to an austenite grain size number according to JIS G0551 ranging from 7.0 to 12.0.

* * * * *